US007642716B2

(12) United States Patent
Hooker et al.

(10) Patent No.: US 7,642,716 B2
(45) Date of Patent: Jan. 5, 2010

(54) LIGHTING MECHANISM HAVING A SUPPLEMENTARY SPACE FORMED WITHIN A CRIMPED PART

(75) Inventors: James D. Hooker, Swansea (GB); Gunther Van De Poel, Kortenaken (GB); Marc Adolf, Tienen (BE)

(73) Assignee: Flowil Lighting International (Holding) B.V., Amsterdam (NL)

( * ) Notice: Subject to any disclaimer, the term of this patent is extended or adjusted under 35 U.S.C. 154(b) by 505 days.

(21) Appl. No.: 11/272,793

(22) Filed: Nov. 15, 2005

(65) Prior Publication Data

US 2006/0197422 A1 Sep. 7, 2006

(30) Foreign Application Priority Data

Nov. 18, 2004 (EP) ..... 04027383

(51) Int. Cl.
*H01K 1/00* (2006.01)
*H01K 1/50* (2006.01)
*H01J 61/30* (2006.01)

(52) U.S. Cl. ..... 313/580; 313/579; 313/634

(58) Field of Classification Search ..... None
See application file for complete search history.

(56) References Cited

U.S. PATENT DOCUMENTS

2001/0003411 A1* 6/2001 Honda et al. ..... 313/607

FOREIGN PATENT DOCUMENTS

DE 102 33 073 B3 2/2004

OTHER PUBLICATIONS

Derwent Abstract for DE 102 33 073 B2.*

* cited by examiner

*Primary Examiner*—Toan Ton
*Assistant Examiner*—Britt D Hanley
(74) *Attorney, Agent, or Firm*—Jean C. Edwards, Esq.; Akerman Senterfitt

(57) ABSTRACT

The invention relates to a lighting mechanism with an elongated shield made of transparent material, a burner disposed in the center of the shield, sealed-off burner connectors including both a proximal burner connector and a distal burner connector, each of which projects diametrically away from the burner in the longitudinal direction of the shield so as to extend into a proximal and a distal end region of the shield. Supply leads pass into the shield by way of a crimped part thereof and are joined there to the burner connectors. In the region of the crimped part a supplementary space is provided that is open to the interior of the shield and into which at least a certain region of the proximal burner connector extends.

18 Claims, 4 Drawing Sheets

LIGHTING MECHANISM HAVING A SUPPLEMENTARY SPACE FORMED WITHIN A CRIMPED PART

CROSS REFERENCE TO RELATED APPLICATIONS

This application claims priority from European Patent Application No. 04 027 383.1, filed Nov. 18, 2004, the contents of which are herein incorporated by reference in their entirety.

BACKGROUND OF THE INVENTION

1. Field of the Invention

The invention relates to a lighting means comprising a tubular shield made of transparent material, in the interior of which are a burner, sealed-off burner connectors including both a proximal and a distal burner connector each of which projects diametrically away from the burner in the long direction of the shield, extending into a proximal and a distal end region of the shield, and supply leads that pass through a crimped part of the shield and there are joined to the burner connectors, as well as to a reflector lamp, in particular a metal-halogen-vapor reflector lamp which includes the lighting means in accordance with the invention.

2. Description of the Related Art

A discharge tube designated here as a "burner" is conventionally housed in an elongated shield made of transparent material, such that the elongated shield (conventional "pinch-seal" shield as shown in FIG. 4) is sealed by crimping. The leads that supply current to the burner are also conventionally passed through this pinch seal. However, an adequate minimal sealing length of the supply leads must be disposed within the crimped part in order to ensure a reliably tight seal between the material of which the shield is made and the supply leads. To accommodate this minimal sealing length, the overall outer dimensions of the shield must be made relatively long, although for a great variety of applications a shorter shield would be desirable, in particular one in which there is a smaller distance between an outer shield end directed toward a base and the center of the burner (light center length).

To obtain a light center length that is as short as possible, and/or to avoid lengthening the shield on account of the problem of sealing off the supply leads in a crimped section, other solutions are also known for sealing the elongated shield and/or making contact with the burner, such as sealing a shield that is open at its end by means of a ceramic disk in combination with special sealing materials (such a conventional disk-sealed shield is shown in FIG. 5). However, this sealing means is laborious and expensive to construct, and the kinds of glass used as material for the shield must have a high coefficient of expansion. Glass types with high coefficients of expansion, however, as a rule have a low softening temperature and are not well suited especially for compact discharge lamps; instead, the glass shield must be considerably expanded around the burner so that its distance from the burner is sufficient to avoid overheating.

The objective of the present invention, in contrast, is to disclose a lighting means of the kind cited at the outset that is as compact as possible and can be manufactured with acceptable effort and expense.

SUMMARY OF THE INVENTION

This objective is achieved by a lighting means having the characteristics where the lighting means can be designed for use with a reflector lamp, in which case because of the compact construction of the lighting means, it is possible, for the first time, to incorporate it into commercially available compact reflector lamps. Advantageous further developments are disclosed herein.

According to a central consideration, in the vicinity of the crimped part of the shield a supplementary space is provided that is open toward the interior of the shield, in particular a supplementary burner space, in which parts of the burner and/or the proximal burner connector can be accommodated, at least in particular regions. This allows the overall length to be reduced. According to another central consideration, as seen in projection onto the longitudinal plane defined by the crimped section of the shield an additional space in the proximal end region of the shield, in particular the supplementary space that communicates with the interior of the shield, is spaced further apart from the burner than the point of entry of the supply leads into the interior of the shield. Viewed in projection onto the longitudinal plane of the shield, the supply leads enter not at the end but rather at the side with reference to the interior of the shield. Viewed in the longitudinal direction of the shield, the supplementary space overlaps at least in certain regions with the crimped part that is needed to seal in the supply leads.

In one embodiment of the present invention the crimped part can have a substantially U-shaped basic form.

In one embodiment of the present invention, the crimped part includes two outer sections as well as a connecting section, in which case the supply leads pass through the outer sections.

The connecting section preferably extends in the long direction of the shield for a shorter distance than do the outer sections. The outer sections should extend in the long direction of the shield at least twice as far as does the connecting section; preferably they are 4 to 10 times, and in particular 7 to 8 times as long as the connecting section.

In another embodiment of the present invention, the supplementary space tapers in the direction away from the burner, so that it is substantially funnel-shaped.

At least in its region toward the burner the supplementary space can have a substantially circular or oval cross-sectional shape in the plane perpendicular to the long direction of the shield.

The supplementary space can have a length, in the long direction of the shield, that is preferably of the order of magnitude of the inside diameter of the shield outside the supplementary space, preferably within the range 80 to 120% of this diameter. The inside diameter of the supplementary space, i.e. its extent in the direction transverse to the long direction of the shield, can be in the range 30 to 70%, preferably about 50 to 55% of the inside diameter of the shield outside the supplementary space.

According to another aspect of the present invention the shield can be dimensioned such that the distance between the center of the burner and an outer edge of the crimped part that faces away from the burner (light center length) is smaller than in conventional lamps with a light center length L' or L" ($L<L'$ or $L<L''$, for a given wattage).

For example, in the case of a 20 W lamp the conventionally required light center length of 22 mm can be distinctly reduced, so that in this exemplary power range a light center length<22 mm can be obtained.

The transparent materials to be considered for the elongated shield are preferably quartz glass, hardened or soft glass, in particular vitreous aluminum silicate.

According to another aspect, the supply leads comprise a proximal as well as a distal lead, such that the proximal supply lead is bent twice, in opposite directions.

The burner connectors can either each be made integral with the supply leads or they can be joined thereto by way of electrically conductive contact sites.

According to another aspect of the present invention the burner can be constructed as a ceramic burner, in particular made of polycrystalline aluminum oxide (PCA).

According to an alternative aspect of the present invention, however, the burner can be manufactured by quartz technology.

The lighting means in accordance with the invention can be used in a reflector lamp, in particular, a metal-halogen-vapor reflector lamp including as the reflector an external enclosure with a neck region, over which a transparent cover is positioned; the lighting means can be positioned on an optical axis within this enclosure.

BRIEF DESCRIPTION OF THE DRAWINGS

In the following the invention is explained in greater detail, also in regard to additional characteristics and advantages, by the description of exemplary embodiments with reference to the attached drawings, wherein.

DESCRIPTION OF THE INVENTION

Figure 4:
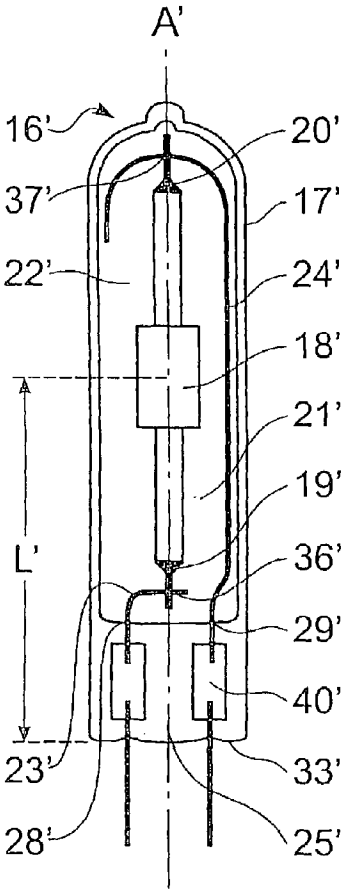
FIG 4 PRIOR ART
FIG. 4 shows a sectional view of a lighting means with pinch seal according to the state of the art.

In FIG. 4 a lighting means with a crimped part 25' according to the state of the art (conventional pinch-seal shield) is shown in section. An elongated, substantially cylindrically constructed shield 17' is hermetically sealed off by the crimped part 25'. In the interior of the shield 17' is situated a burner 18' with burner connectors 19', 20'. Because of the severe heating in the region of the burner 18', the burner connectors 19', 20' must reach to a sufficient distance away from the burner 18'. The diametrically opposed burner connectors 19', 20', which project into a proximal end region 21' and distal end region 22', respectively, are joined in an electrically conductive manner to supply leads 23', 24' at contact sites 36, 37', in order to supply current to the burner 18'. The supply leads 23', 24' simultaneously provide mechanical fixation of the burner 18' within the interior of the shield 17'. It is relatively problematic to arrange passage of the supply leads 23', 24' into the interior of the shield 17'. For this purpose the supply leads 23', 24' are guided through the above-mentioned crimped part 25', certain regions of the supply leads 23', 24' being constructed in the form of a thin sheet of molybdenum 40' in order to ensure reliable sealing, even over long periods of operation, between the leads and the crimped part 25' of the shield 17', which as a rule is made of quartz glass. However, a disadvantage lies in the resulting overall length of the shield 17', in particular the large distance separating the center of the burner 18' from an outer edge 33' of the crimped part 25' (light center length L').

Figure 5:
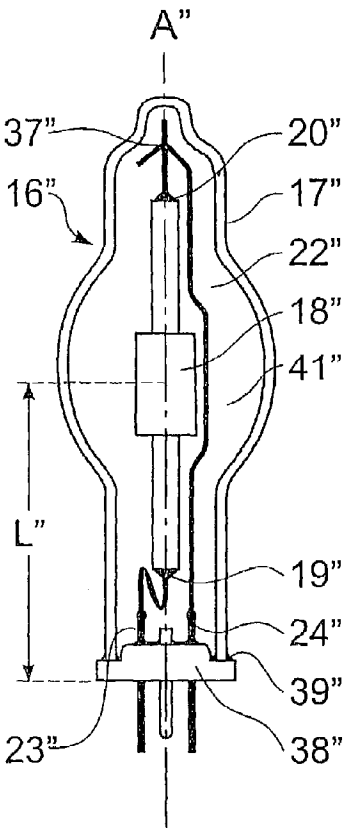
FIG 5 PRIOR ART
FIG. 5 shows a sectional view of a lighting means with ceramic sealing disk according to the state of the art.

A means of shortening this length is already known from the state of the art, as shown in FIG. 5: this is a lighting means 16" with a shield 17" of the conventional kind sealed off with a ceramic disk, in which case the light center length L" is shortened by elimination of the crimped part. The shield 17" in this case is hermetically closed not by crimping but rather by the ceramic disk 38" with the aid of sealing means 39" or sealing paste between shield and ceramic disk 38". The supply leads 23", 24" accordingly need not be passed through a crimped part, but rather can be passed through the ceramic disk 38" in a gas-tight manner. However, it is difficult to complete the electrical and mechanical connection between the supply leads 23", 24" and the burner connectors 19" 20" of a burner 18". In order to bring about sufficiently reliable sealing between shield, sealing means 39" and ceramic disk 38", soft glass must be used for the shield, and such glass is considerably less resistant to the heat produced by the burner 18". Hence an expanded section 41" must be provided around the burner 18", in order to avoid overheating of the shield 17". On the whole, then, especially because of the expansion 41" and the ceramic disk 38", the manufacturing expense is considerably increased.

Figure 1:
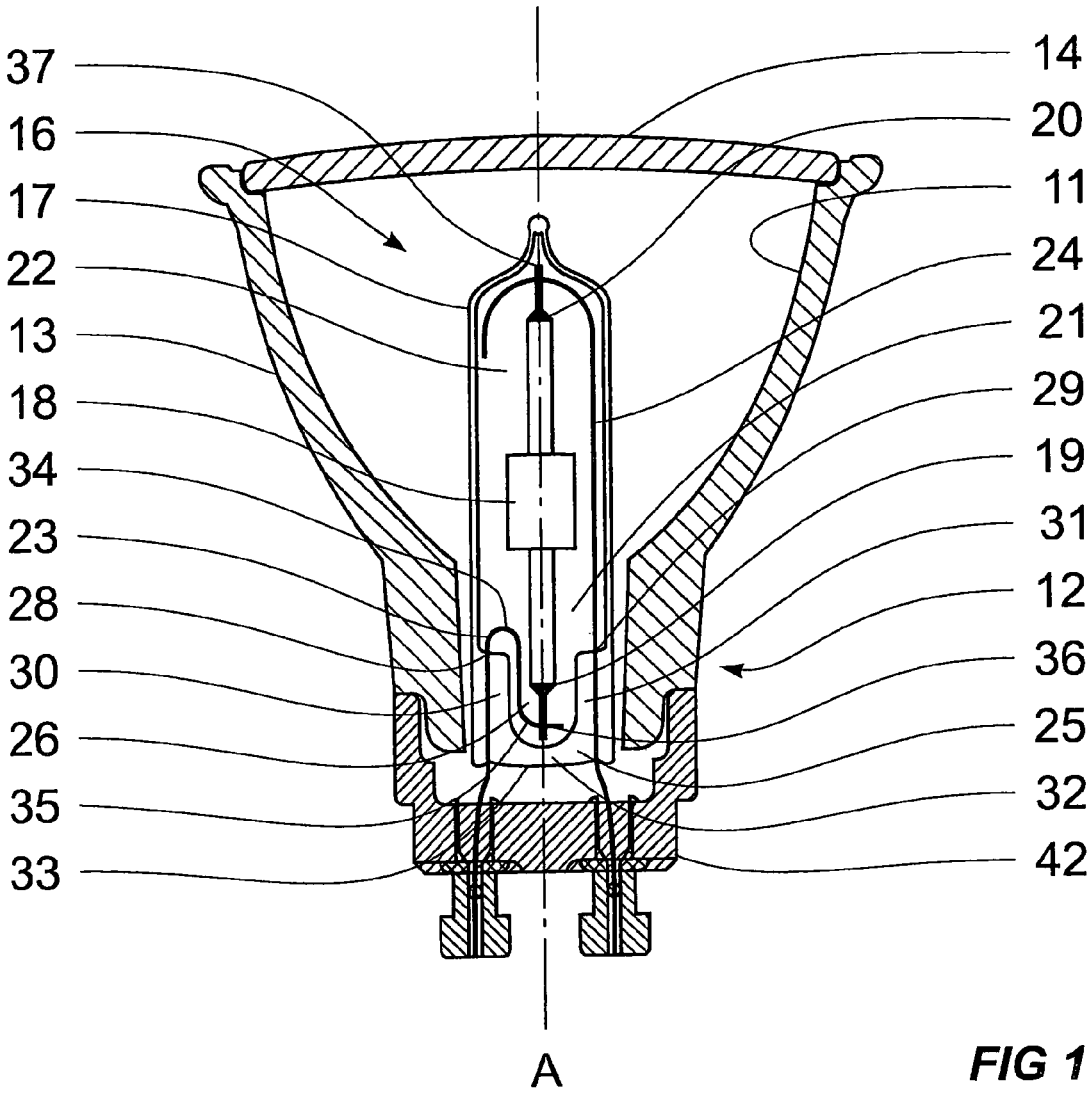
FIG. 1 shows an embodiment of a reflector lamp in accordance with the invention in sectional view.
Figure 2:
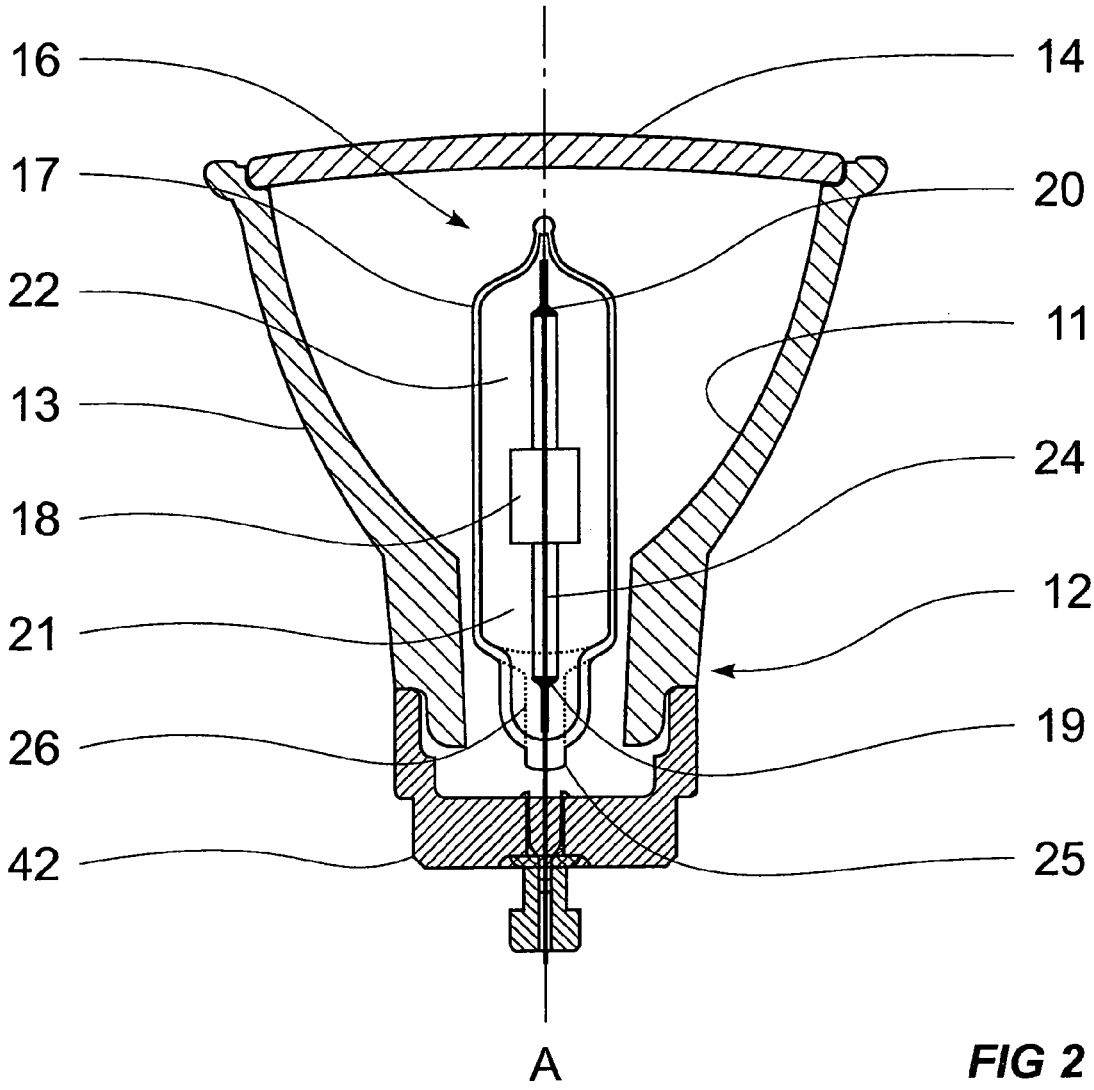
FIG. 2 shows the reflector lamp according to FIG. 1 in a sectional view orthogonal thereto.

FIGS. 1 and 2 show an embodiment of a reflector lamp in accordance with the invention as it appears in two orthogonal sections. The reflector lamp comprises, firstly, an outer enclosure 13 constructed as a reflector 11 with a neck region 12, with a transparent cover 14 positioned on top of the enclosure 13. The transparent cover 14 can serve exclusively as a cover or can also constitute a lens by means of which the light is focused as desired. On a central optical axis A a lighting means 16 is disposed. The lighting means 16 comprises a shield 17, here made of glass with a high softening point, which at its end facing the neck region 12 of the reflector lamp is closed in a gas-tight manner by a crimped part 25. In the interior of the shield 17 is a burner 18, which in the present embodiment is constructed as a ceramic burner. The burner 18 forms a metal-halogen-vapor discharge tube, whereas it has conventionally not been possible for ceramic burners suitable for a metal-halogen-vapor lamp to be used in a reflector lamp with a reflector of about 50 mm (2 inches) diameter (MR 16 or ES 50), such as are described in particular in DE 102 33 073 B3. The shield in accordance with the invention is distinguished by a very compact structure, i.e. its length along the optical axis A is small, which is achieved as follows: in the region of the crimped part 25, in a proximal end region 21 of the shield 17, a supplementary space 26 is formed, which is open to the interior of the shield 17 and into which the burner 18 or parts thereof, namely the burner connectors 19, 20, project to at least a certain extent. As a result, the distance between an outer edge 33 (facing away from the burner 18) of the crimped part 25 and the center of the burner 18 (light center length) can be shortened.

In concrete terms, the burner 18 comprises burner connectors 19, 20 oriented parallel to the optical axis A and hence diametrically opposed to one another, namely a proximal burner connector 19 which at its end extends into the supplementary space 26, and a distal burner connector 20 at the opposite end of the shield. The crimped part 25 differs from the state of the art as shown in FIG. 5 in that it is constructed not as a flat, rectangular section of the shield 17 but rather as a flat, substantially U-shaped element. The crimped part 25 in the embodiment illustrated here comprises a first outer section 30 as well as a second outer section 31, which are joined to one another by a connecting section 32. The route of the supply leads 23, 24 through the outer sections 30, 31 is gas-tight, and at entry points 28, 29 the leads emerge from the crimped part 25 and enter the interior of the shield 17. The entry points 28, 29 as seen in projection onto the optical axis A, i.e. onto the longitudinal extent of the shield 17, are closer to the burner 18 than is the floor of the supplementary space 26. Hence the supply leads 23, 24 enter the interior of the shield 17 not at its floor, but rather laterally. The supply leads 23, 24 comprise a proximal supply lead 23 as well as a distal supply lead 24. Within the shield 17 the proximal supply lead 23 exhibits a first bend 34 as well as a second bend 35, such that the first bend 34 and second bend 35 are oppositely directed. The first bend 34 is configured as a U-shaped, 180° curve. The oppositely directed second bend 35 forms a 90° curve, after which the lead makes an electrically conductive junction with the proximal burner connector 19 within the supplementary space 26, by way of a contact site 36. The distal supply lead 24 passes through the opposite side of the crimped part 25, i.e. through the second outer section 31, and then runs parallel to the shield wall into the shield's distal end region 22, where it makes an electrically conductive junction with the distal burner connector 20 by way of a contact site 37. The distance separating the contact sites 36, 37 from the center of the burner 18 is determined by the fact that the burner connectors must be made sufficiently long on account of the enormous amount of heat produced. If the burner connectors 19, 20 are made too short, it cannot be guaranteed that the sealing at the burner connectors 19, 20 will be adequate for the lifetime of the burner 18.

The supply leads 23, 24 can be passed through the crimped part 25 as conductors with a circular cross section if the shield 17 is made of hardened glass. In contrast, if the shield 17 is made of quartz glass the circular leads 23, 24 are interrupted in the region of the crimped part 25, and in this region are replaced by a thin sheet of material, preferably molybdenum (cf. FIG. 7).

The lighting means 16 is normally attached to the reflector 11 in combination with a base 42, by means of a ceramic cement. The supply leads 23 and 24 make electrically conductive connection with contact pins in the base 42.

Figure 3:
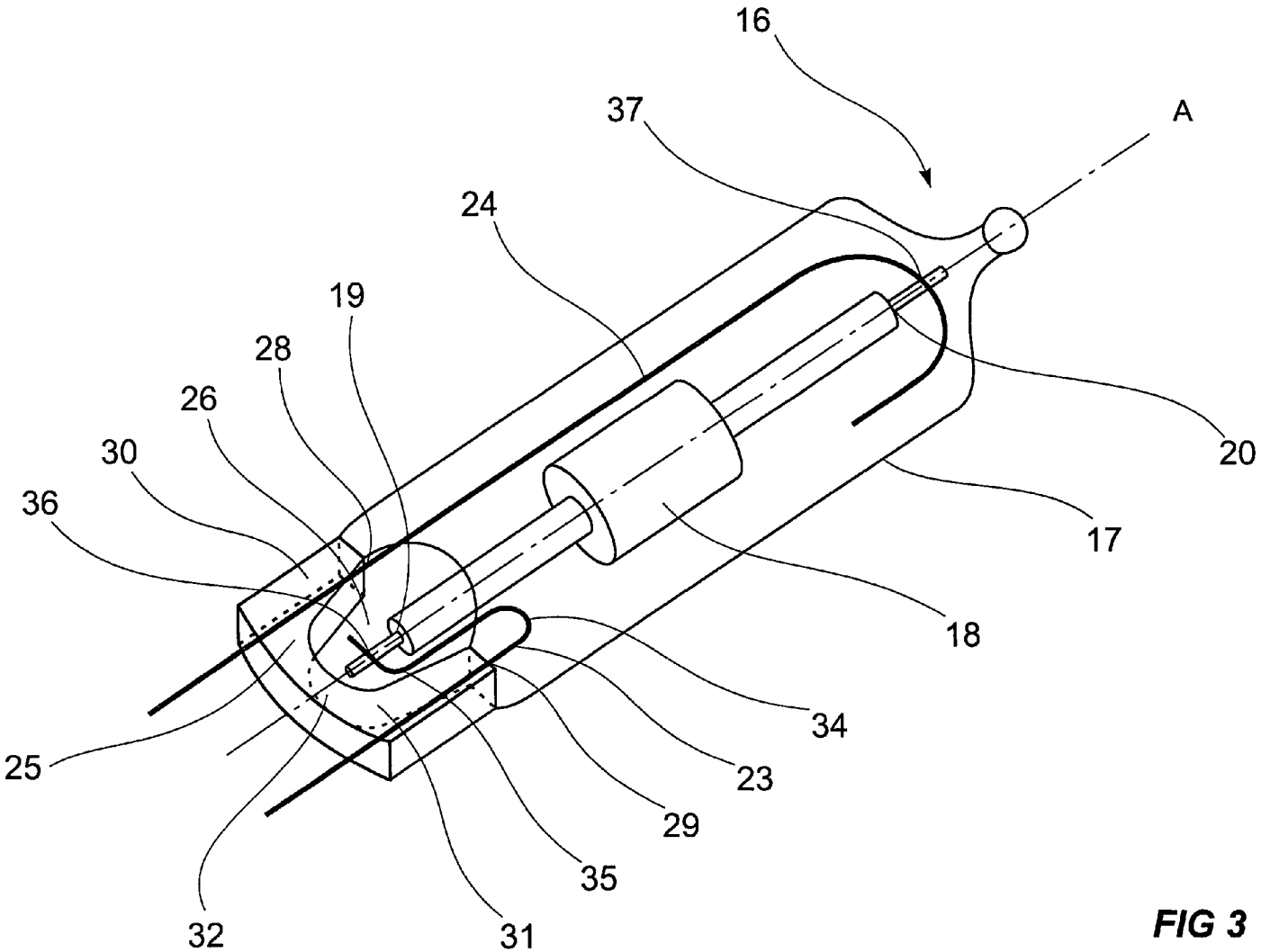
FIG. 3 shows a schematic perspective view of an embodiment of a lighting means in accordance with the invention.

In FIG. 3 an embodiment of a lighting means 16 according to the invention that corresponds substantially to the embodiment illustrated in FIGS. 1 and 2 is shown schematically in perspective.

The supplementary space 26 tapers in the direction away from the burner 18, in substantially a funnel shape. Its length in the direction of the optical axis A is of the order of magnitude of the diameter of the shield 17, or even greater than the diameter of the shield 17.

Owing to the provision of the supplementary space 26 in accordance with the invention it is possible to insert a lighting means having a ceramic burner of the metal-halogen-vapor discharge lamp type into a commercially available reflector lamp with ca. 50 mm (2 inches) diameter, according to the standard MR 16 or ES 50.

Figure 6:
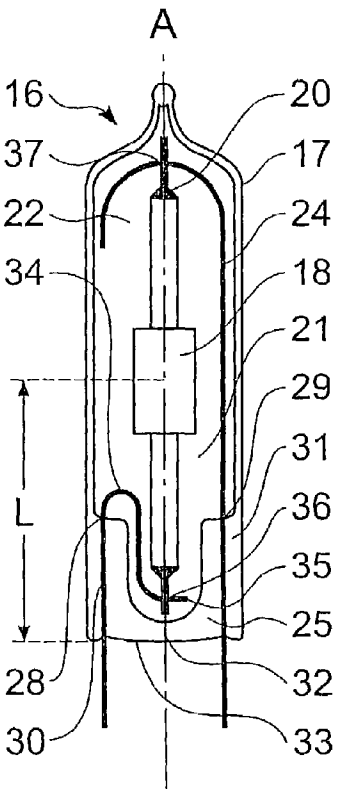
FIG. 6 shows the lighting means already illustrated in FIGS. 1, 2 and 3.

In FIG. 6 the lighting means in accordance with the invention that has already been described with reference to FIGS. 1 and 2 is shown again, for comparison with the lighting means according to the state of the art shown in FIGS. 4 and 5, in particular to make clear the distinctly shorter light center length L. In the embodiment according to FIG. 6 the shield 17 is made of hardened glass.

Figure 7:
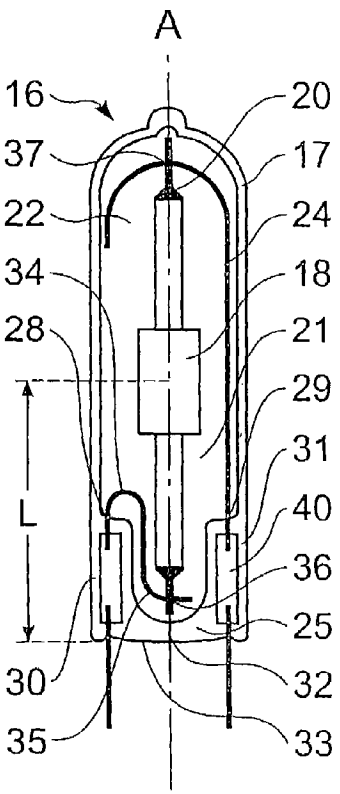
FIG. 7 shows an embodiment of the lighting means in accordance with the invention that has been modified with respect to the embodiment shown in FIG. 6.

In FIG. 7 another embodiment of the lighting means 16 in accordance with the invention is illustrated for comparison with the lighting means shown in FIGS. 4 to 6; this embodiment has again been modified, namely in that the shield 17 is made of quartz glass. The structure of the lighting means 16 according to FIG. 7 corresponds substantially to that of the lighting means according to FIG. 6. To achieve sufficient sealing of the places where the supply leads 23, 24 pass through the crimped part 25 in accordance with the invention, a sufficiently long section of each of the supply leads 23, 24 is advantageously made of thin molybdenum foil 40. With such a molybdenum foil section it is possible to ensure adequately thorough sealing of the crimped part 25 even over extremely long operating periods.

What is claimed is:

1. A lighting mechanism with an elongated shield made of a transparent material, comprising: a burner disposed in an interior of the shield; sealed-off burner connectors including both a proximal burner connector and a distal burner connector, each of which projects diametrically away from the burner in a longitudinal direction of the shield, extending into a proximal and a distal end region of the shield; and supply leads that pass into the shield by way of a crimped part thereof and are joined thereat to the burner connectors; wherein the crimped part defines therein a supplementary cavity which is fully open to the interior of the shield and into which at least a certain region of the proximal burner connector extends.

2. The lighting mechanism according to claim 1, wherein, as seen in projection onto the longitudinal plane of the shield defined by the crimped part, the supplementary space in the proximal end region of the shield, which communicates with the interior of the shield, is further away from the burner than are the entry points of the supply leads into the interior of the shield.

3. The lighting mechanism according to claim 2, wherein the crimped part has a U-shaped basic form.

4. The lighting mechanism according to claim 3, wherein the crimped part comprises two outer sections as well as a connecting section, such that the supply leads pass through the outer sections.

5. The lighting mechanism according to claim 4, wherein the outer sections are so constructed that in the longitudinal direction of the shield they are at least one of twice as long as is the connecting section, four to ten times as long, or about seven to eight times as long.

6. The lighting mechanism according to claim 5, wherein the supplementary space tapers in a direction away from the burner, so as to be substantially funnel-shaped.

7. The lighting mechanism according to claim 6, wherein the supplementary space, at least in the region thereof that faces toward the burner, has a substantially circular or oval cross-sectional form in a direction perpendicular to the longitudinal extent of the shield.

8. The lighting mechanism according to claim 7, wherein a maximal inside diameter of the supplementary space in the direction perpendicular to the longitudinal extent of the shield amounts to one of between 30 and 70% of an average inside diameter of the shield in a remaining interior of the shield, or about 50 to 55% of the latter diameter.

9. The lighting mechanism according to claim 8, wherein the shield is dimensioned such that a distance L between a center of the burner and an outer edge of the crimped part that faces away from the burner, is smaller than a corresponding distance L' or L" in a conventional lamp of a same wattage.

10. The lighting mechanism according to claim 9, wherein the transparent material of which the elongated shield is made is one of quartz glass, hardened glass or soft glass.

11. The lighting mechanism according to claim 10, wherein the supply leads comprise a proximal supply lead and a distal supply lead, such that the proximal supply lead is bent in opposite directions at two sites.

12. The lighting mechanism according to claim 11, wherein the burner connectors are one of made integral with the corresponding supply leads, and form electrically conductive junctions therewith by way of contact sites.

13. The lighting mechanism according to claim 12, wherein the burner is constructed as a ceramic burner, made of polycrystalline aluminum oxide (PCA).

14. The lighting mechanism according to claim 13, wherein the burner is constructed by a quartz technology.

15. A metal-halogen-vapor reflector lamp, comprising: an external enclosure which is constructed as a reflector, with a neck region, and is closed by a transparent cover; and a lighting mechanism with an elongated shield made of a transparent material, including: a burner disposed in an interior of the shield; sealed-off burner connectors including both a proximal burner connector and a distal burner connector, each of which projects diametrically away from the burner in a longitudinal direction of the shield, extending into a proximal and a distal end region of the shield; and supply leads that pass into the shield by way of a crimped part thereof and are joined thereat to the burner connectors; wherein the crimped part defines therein a supplementary cavity which is fully open to the interior of the shield and into which at least a certain region of the proximal burner connector extends; and which is disposed on an optical axis within the enclosure.

16. A lighting mechanism with an elongated shield made of a transparent material, comprising:

a burner disposed in an interior of the shield;

sealed-off burner connectors including both a proximal burner connector and a distal burner connector, each of which projects diametrically away from the burner in a longitudinal direction of the shield, extending into a proximal and distal end region of the shield; and supply leads that pass into the shield by way of a crimped part thereof and are joined to the burner connectors;

wherein in the region of the crimped part a supplementary space is provided that is open to the interior of the shield and into which at least a certain region of the proximal burner connector extends, and wherein, as seen in projection onto the longitudinal plane of the shield defined by the crimped part, the supplementary space in the proximal end region of the shield, which communicates with the interior of the shield, is further away from the burner than are the entry points of the supply leads into the interior of the shield.

17. The lighting mechanism according to claim 16, wherein the crimped part has a U-shaped basic form.

18. A lighting mechanism with an elongated shield made of a transparent material, comprising:

a burner disposed in an interior of the shield;

sealed-off burner connectors including both a proximal burner connector and a distal burner connector, each of which projects diametrically away from the burner in a longitudinal direction of the shield, extending into a proximal and distal end region of the shield; and supply leads that pass into the shield by way of a U-shaped crimped part thereof and are joined to the burner connectors;

wherein the U-shaped crimped part defines therein a supplementary space that is fully open to the interior of the shield and into which at least a certain region of the proximal burner connector extends.

* * * * *